US009331394B2

(12) United States Patent
Toledo

(10) Patent No.: US 9,331,394 B2
(45) Date of Patent: May 3, 2016

(54) REFLECTOR SYSTEMS HAVING STOWABLE RIGID PANELS

(75) Inventor: Gustavo A. Toledo, Rockledge, FL (US)

(73) Assignee: Harris Corporation, Melbourne, FL (US)

( * ) Notice: Subject to any disclaimer, the term of this patent is extended or adjusted under 35 U.S.C. 154(b) by 664 days.

(21) Appl. No.: 13/238,159

(22) Filed: Sep. 21, 2011

(65) Prior Publication Data

US 2013/0069849 A1 Mar. 21, 2013

(51) Int. Cl.
*H01Q 15/20* (2006.01)
*H01Q 15/16* (2006.01)

(52) U.S. Cl.
CPC ..... *H01Q 15/20* (2013.01); *H01Q 15/162* (2013.01)

(58) Field of Classification Search
CPC ..... H01Q 1/288; H01Q 1/161; H01Q 15/16; H01Q 15/161; H01Q 15/162; H01Q 15/20
USPC ..... 343/839, 840, 915; 136/244, 245, 246
See application file for complete search history.

(56) References Cited

U.S. PATENT DOCUMENTS

| | | | | |
|---|---|---|---|---|
| 2,763,002 | A | | 9/1956 | Fitzgerald et al. |
| 3,235,872 | A | | 2/1966 | Schepis |
| 3,286,259 | A | | 11/1966 | Carman et al. |
| 3,286,270 | A | | 11/1966 | Kelly |
| 3,360,798 | A | | 12/1967 | Webb |
| 3,372,396 | A | | 3/1968 | Braccini |
| 3,541,569 | A | | 11/1970 | Berks et al. |
| 3,715,760 | A | | 2/1973 | Palmer |
| 3,717,879 | A | | 2/1973 | Ganssle |
| 3,971,023 | A | | 7/1976 | Taggart |
| 3,978,490 | A | | 8/1976 | Fletcher et al. |
| 4,030,103 | A | | 6/1977 | Campbell |
| 4,201,991 | A | | 5/1980 | Vines |
| 4,315,265 | A | | 2/1982 | Palmer et al. |
| 4,506,271 | A | | 3/1985 | Gonzalez |
| 4,511,901 | A | | 4/1985 | Westphal |
| 4,527,166 | A | | 7/1985 | Luly |
| 4,529,277 | A | | 7/1985 | Gee et al. |
| 4,608,571 | A | | 8/1986 | Luly |
| 4,642,652 | A | | 2/1987 | Herbig et al. |
| 4,646,102 | A | | 2/1987 | Akaeda et al. |
| 4,780,726 | A | | 10/1988 | Archer et al. |
| 4,783,662 | A | | 11/1988 | Wirth, Jr. et al. |
| 4,811,034 | A | | 3/1989 | Kaminskas |
| 4,815,525 | A | * | 3/1989 | Readman ..... 165/41 |
| 4,862,190 | A | | 8/1989 | Palmer et al. |
| 4,893,132 | A | | 1/1990 | Habibi |
| 4,899,167 | A | | 2/1990 | Westphal |

(Continued)

FOREIGN PATENT DOCUMENTS

| | | | |
|---|---|---|---|
| GB | 920530 | * | 3/1963 |

*Primary Examiner* — Hoang V Nguyen
*Assistant Examiner* — Daniel J Munoz
(74) *Attorney, Agent, or Firm* — Fox Rothschild, LLP; Robert J. Sacco; Carol E. Thorstad-Forsyth

(57) ABSTRACT

Reflector systems (10) comprising a reflector (11) formed from rigid panels (14) mounted on a centrally-located hub (12) are provided. The panels (14) can be stowed in a relatively compact manner in which the panels (14) overlap. The panels (14) can translate with a combination of rotational and linear motion so that the panels (14) become disposed in a side by side relationship, thereby deploying the reflector (11) so that the reflector (11) can focus electromagnetic energy incident thereupon.

18 Claims, 15 Drawing Sheets

(56) References Cited

U.S. PATENT DOCUMENTS

| | | | | | |
|---|---|---|---|---|---|
| 5,061,945 | A | * | 10/1991 | Hull et al. | 343/840 |
| 5,128,688 | A | * | 7/1992 | West | 343/766 |
| 5,198,832 | A | | 3/1993 | Higgins et al. | |
| 5,255,006 | A | | 10/1993 | Pappas et al. | |
| 5,257,034 | A | | 10/1993 | Turner et al. | |
| 5,334,990 | A | | 8/1994 | Robinson | |
| 5,451,975 | A | | 9/1995 | Miller et al. | |
| 5,644,322 | A | | 7/1997 | Hayes et al. | |
| 6,219,009 | B1 | * | 4/2001 | Shipley et al. | 343/915 |
| 6,344,835 | B1 | | 2/2002 | Allen et al. | |
| 6,421,022 | B1 | | 7/2002 | Patenaude et al. | |
| 6,828,949 | B2 | | 12/2004 | Harless | |
| 6,930,654 | B2 | | 8/2005 | Schmid et al. | |
| 6,956,696 | B2 | | 10/2005 | Hachkowski et al. | |
| 2004/0196207 | A1 | * | 10/2004 | Schefter et al. | 343/878 |
| 2008/0068283 | A1 | * | 3/2008 | Sankela et al. | 343/915 |
| 2009/0213031 | A1 | | 8/2009 | Taylor et al. | |
| 2010/0018026 | A1 | | 1/2010 | Bassily | |

* cited by examiner

REFLECTOR SYSTEMS HAVING STOWABLE RIGID PANELS

BACKGROUND OF THE INVENTION

1. Statement of the Technical Field

The inventive arrangements relate to reflectors that focus electromagnetic energy in applications such as, but not limited to, radio-frequency (RF) antennae, solar collectors, cameras and other optical devices, etc.

2. Description of the Related Art

Reflectors used in RF antennas, solar collectors, optical devices, etc. are usually shaped so as to focus electromagnetic energy at a particular point or area, or in a particular direction, such as at an antenna feed system mounted on or proximate the reflector. Reflectors of this kind are commonly shaped to have a three-dimensional curved surface, such as a parabolic surface. Reflectors are usually configured in a solid or a mesh configuration. A solid reflector may comprise, for example, a rigid frame with a solid reflective skin mounted thereon. Wire mesh reflectors typically comprise a flexible metallic mesh supported on a framework of rigid, radially-oriented ribs.

Solid reflectors generally provide higher performance than mesh reflectors, i.e., a solid reflector usually will focus the electromagnetic energy incident thereupon with less loss as compared to a mesh reflector of the same or similar size. Moreover, the mesh of a mesh reflector may require individual positional or cord adjustments at hundreds or even thousands of locations thereon during its assembly and after deployment to achieve a required performance level. Even with such time-consuming and labor-intensive adjustments, it can be difficult to achieve a surface roughness, i.e., deviation from an ideal surface profile, of less that 0.010-inch (0.25 mm) in a mesh reflector. A surface roughness of 0.010-inch or less is generally required when the reflector is used to focus high-frequency RF signals such as Ka and Ku-band transmissions. Thus, the performance of wire-mesh reflectors is usually limited in such applications.

Mesh reflectors, however, can have advantages relating their stored volume. In particular, mesh reflectors usually can be folded into a compact configuration, thereby facilitating storage in relatively small volumes. A typical solid reflector, by contrast, is not foldable, and therefore has a larger ratio of stowed-to-deployed volume than a mesh reflector having an aperture of comparable size. This characteristic can be particularly disadvantageous in satellite and other space-based applications due to limitations on the size of the fairings in which the reflectors are typically stowed prior to deployment. Solid reflectors with apertures greater than 3.5 m typically need to be partitioned to fit in the fairing volume, making mesh reflectors more attractive for larger aperture reflectors. Thus, solid reflectors having apertures greater 3.5 meters (11.5 feet) diameter are not commonly used in space-based applications, or in airborne and other mobile applications.

SUMMARY OF THE INVENTION

Reflector systems comprising a reflector formed from rigid panels mounted on a centrally-located hub are provided. The panels can be stowed in a relatively compact arrangement in which the panels overlap. The panels are configured to translate with a combination of rotational and linear motion so that the panels become disposed in a side by side relationship, thereby deploying the reflector so that the reflector can focus electromagnetic energy incident thereupon.

A reflector system comprises a plurality of reflective panels, and a hub. The hub comprises a plurality of concentric rings each having a respective one of the panels mounted thereon, and an actuator mechanically coupled to the panels through the rings. The actuator is operable to move the panels between a stowed configuration wherein the panels are stacked in relation to each other, and a deployed configuration wherein the panels are positioned in a side by side relationship so that the panels form a reflector capable of focusing electromagnetic energy incident thereupon.

Another reflector system comprises a hub having a plurality of concentric rings. The system also comprises a plurality of rigid panels mounted on the rings and configured to move between a stowed configuration wherein the panels substantially overlap, and a deployed configuration wherein the panels form a reflector capable of focusing electromagnetic energy incident thereupon.

An antenna system comprises a feed system, and a reflector system. The reflector system comprises a hub and a plurality of rigid panels mounted on the hub. The panels are configured to move between a stowed configuration wherein the panels substantially overlap, and a deployed configuration wherein the panels form a reflector capable of focusing radio-frequency energy at the feed system.

BRIEF DESCRIPTION OF THE DRAWINGS

Embodiments will be described with reference to the following drawing figures, in which like numerals represent like items throughout the figures and in which.

Figure 12A:
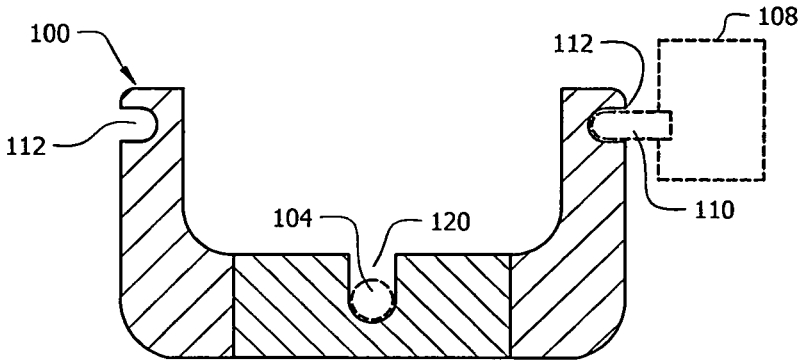
FIG. 12A is a cross-sectional view of a synchronizer of the reflector system shown in FIGS. 1-11.
Figure 12B:
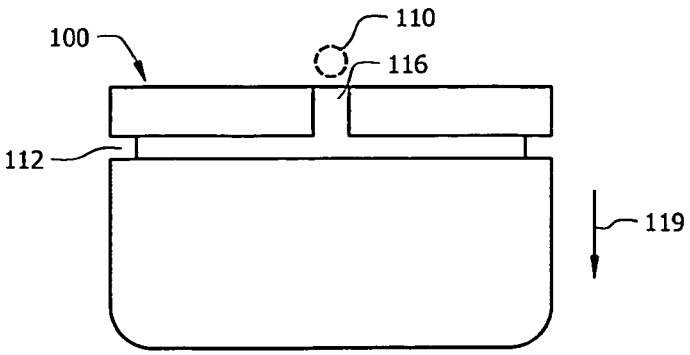
FIG. 12B is a side view of the synchronizer shown in FIG. 12A.
Figure 12C:
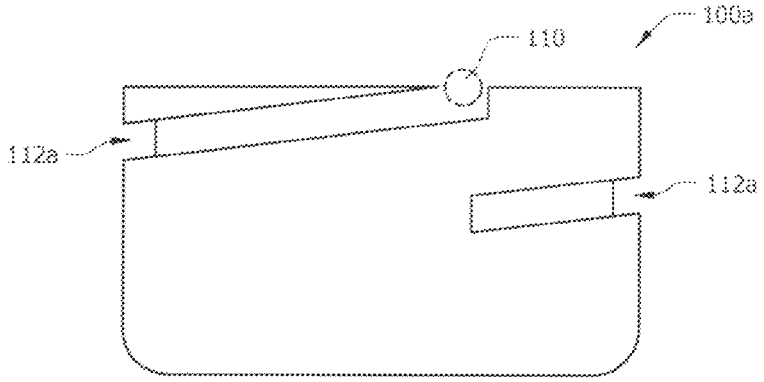
Figure 13:
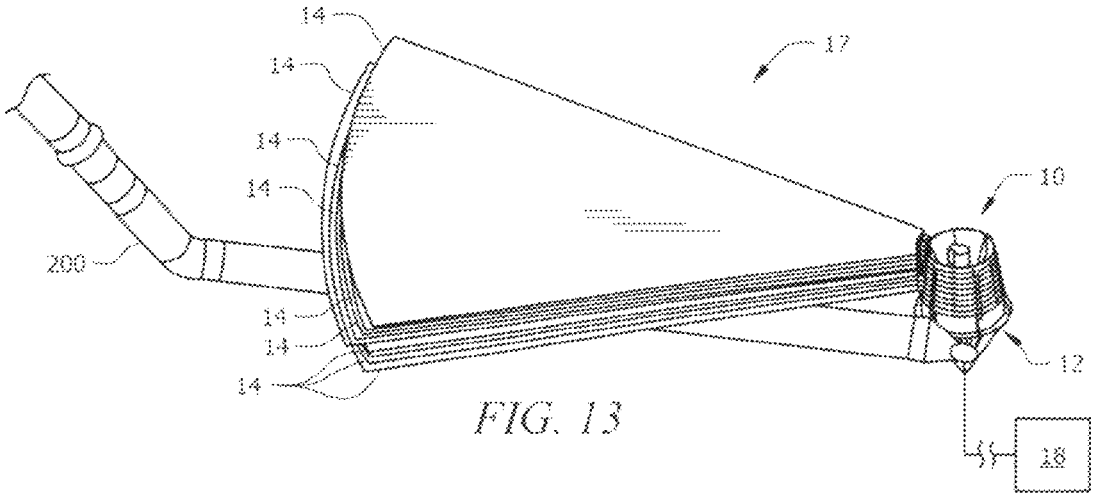
Figure 14:
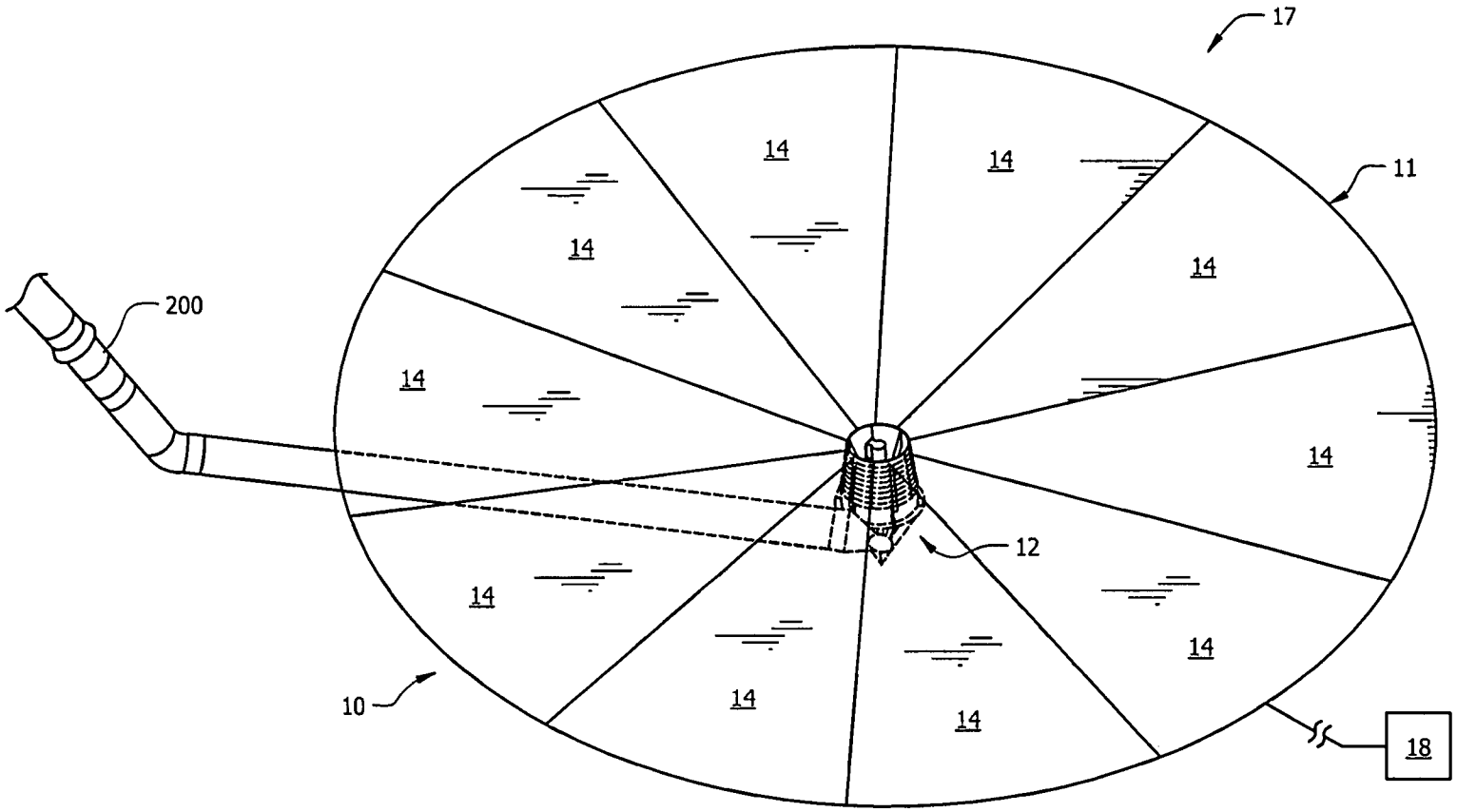
Figure 15:
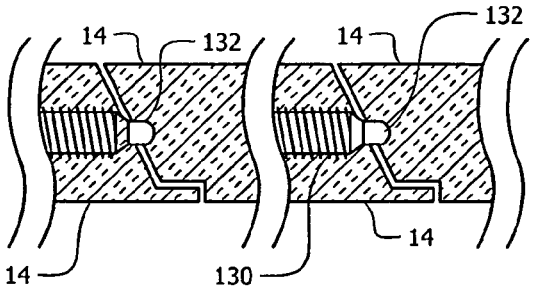
Figure 16:
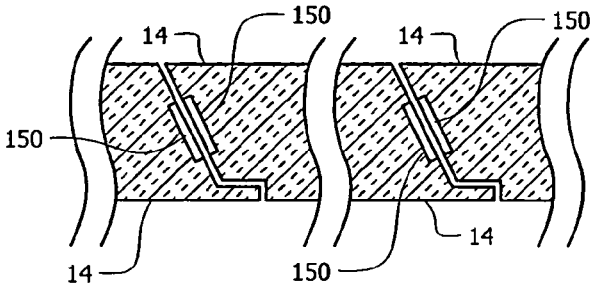
Figure 17:
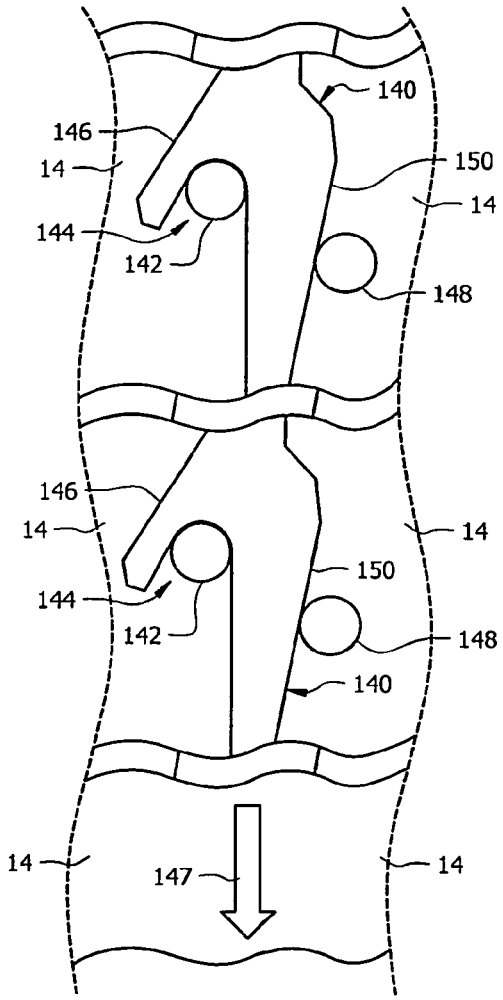
Figure 18:
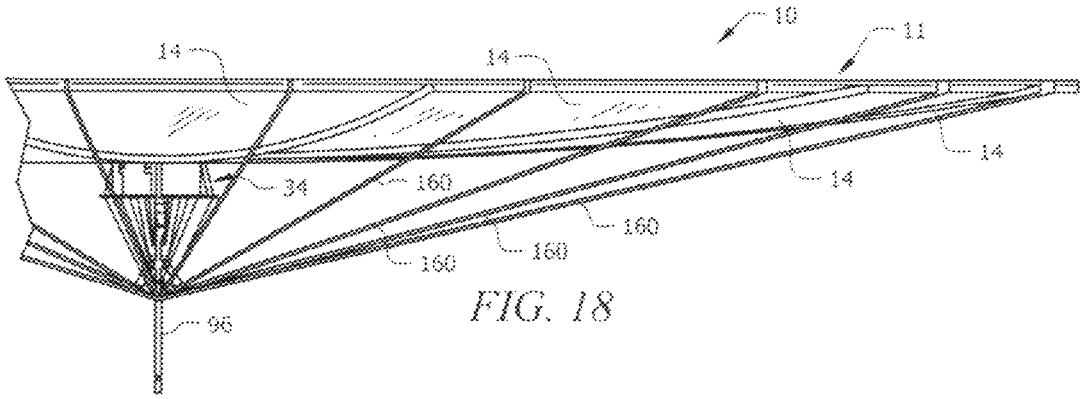
Figure 19:
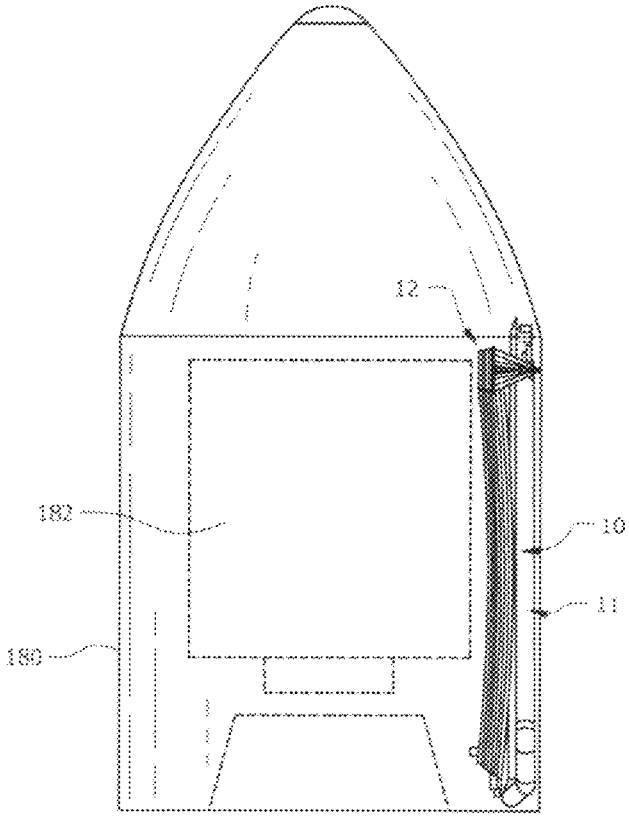
Figure 20:
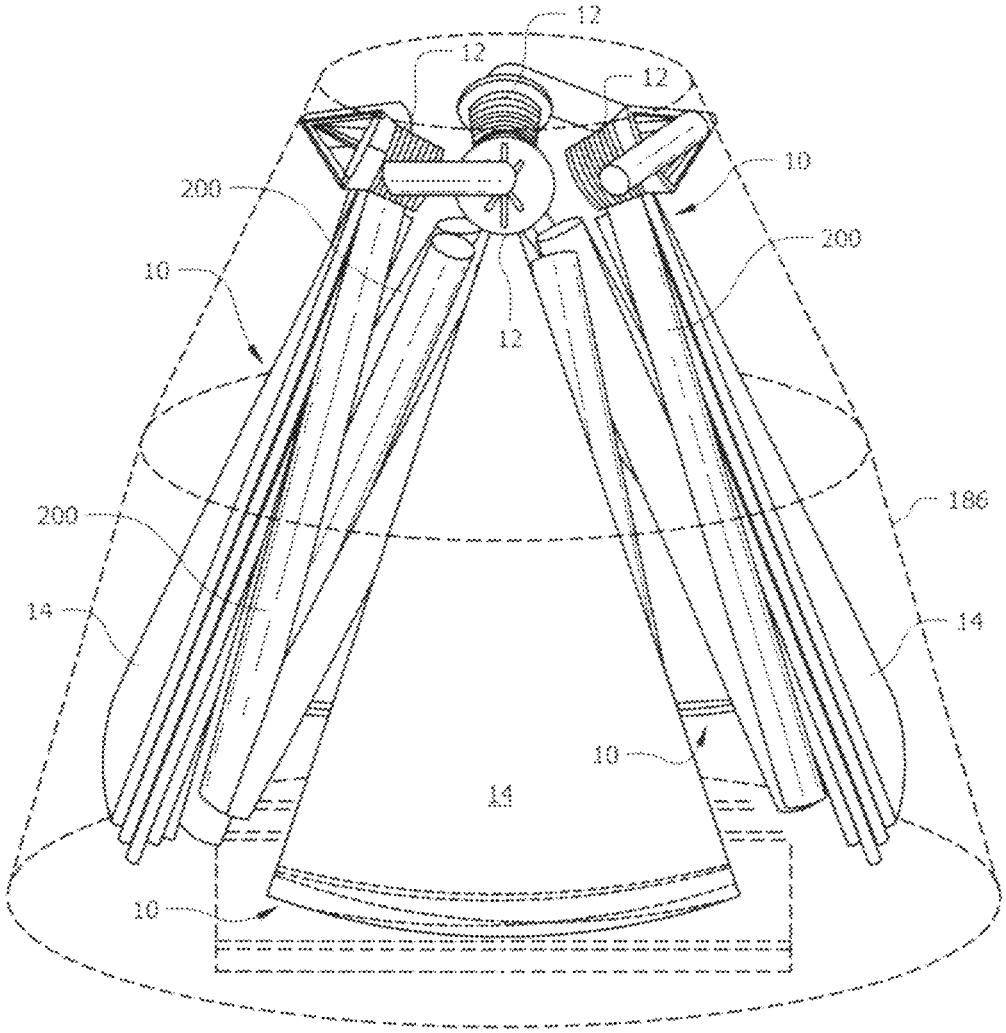

FIB. 12C is a side view of an alternative embodiment of the synchronizer shown in FIGS. 12A and 12B;

FIG. 13 is a perspective view of an antenna system comprising the reflector system shown in FIGS. 1-12B, depicting the reflector system mounted on a boom arm, with the panels of the reflector system in the stowed configuration and the hub in the extended configuration;

FIG. 14 is a perspective view of the antennas system shown in FIG. 13, with the panels of the reflector system in the deployed configuration and the hub in the retracted configuration;

FIG. 15 is a cross-sectional view of adjacent panels of the reflector system shown in FIGS. 1-14, equipped with a means for interlocking the panels thereof;

FIG. 16 is a cross-sectional view of adjacent panels of the reflector system shown in FIGS. 1-15, equipped with another means for interlocking the panels thereof;

FIG. 17 is a top view of adjacent panels of the reflector system shown in FIGS. 1-16, equipped with another means for interlocking the panels thereof;

FIG. 18 is a side view of the reflector system shown in FIGS. 1-17, equipped with another means for interlocking the panels thereof;

FIG. 19 is a side view of the reflector system shown in FIGS. 1-18 mounted on a satellite and positioned with the satellite within the fairing of a launch vehicle, with the panels of the reflector system in the stowed configuration; and FIG. 20 is a side view of four of the reflector systems shown in FIGS. 1-18, positioned within a common fairing of a launch vehicle.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The figures depict a reflector system 10. The reflector system 10 comprises a reflector 11, and a hub 12. The reflector 11 comprises ten solid-skin, rigid panels 14 mounted on the hub 12 via mounts 13 as shown in FIG. 5. The reflector system 10 can be configured in a stowed configuration shown in FIGS. 1, 5, 9, 13, 19, and 20, and a deployed configuration shown in FIGS. 4, 8, 10, 14, and 18. The panels 14 are vertically aligned, or stacked, when the reflector system 10 is in its stowed configuration, thereby facilitating storage of the reflector system 10 within a relatively small volume. Adjacent panels 14 are located side by side when the reflector system 10 is in its deployed configuration.

The reflector system 10 can be part of an antenna system 17, which may be a Ka band antenna for example. The antenna system 17 can include a feed system 18 directly mounted to the reflector system 10. The feed system 18 is depicted schematically in FIGS. 13 and 14. The feed system 18 can have a direct-fed, center-fed, offset-fed, or other configuration. The use of the reflector system 10 as part of a Ka-band antenna is disclosed for exemplary purposes only. The reflector system 10, and alternative embodiments thereof, can be used as part of an antenna for other frequency bands, and can be used in other applications such as solar-energy collectors, cameras, and other optical devices.

The optimal number of panels 14 in the reflector system 10 is application-dependent, and can vary with operational requirements such as the diameter of the reflector 11, the gain of the reflector 11, the relative positions of the feed system 18 and the reflector 11, the operating frequency of the feed system 18, the stored volume of the reflector system 10, etc.

Each panel 14 can include a core (not shown), and a solid external skin 22 that covers the core. The skin can be formed from, for example, graphite. The core can be formed from, for example, aramid, aluminum, or graphite, and can have a honeycomb structure. Specific materials for the core and the skin 22, and a specific type of structure for the core are disclosed for exemplary purposes only. Other types of materials for the core and skin 22, and other types of structures for the core can be used in the alternative. Moreover, the panels 14 can be formed from a rigid wire-mesh in alternative embodiments.

Figure 4:
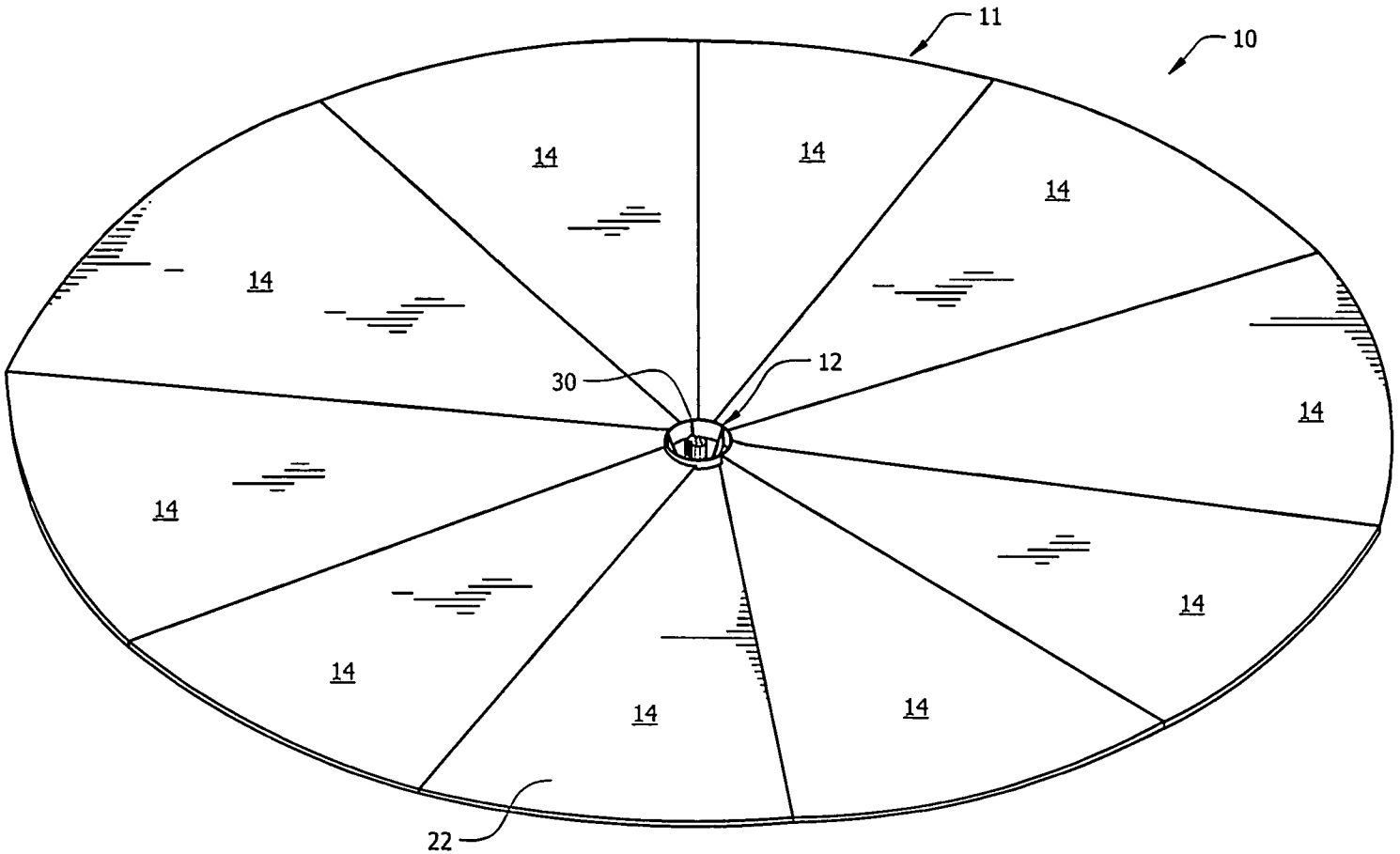
FIG. 4 is a perspective view of the reflector system shown in FIGS. 1-3, with the panels in a deployed configuration and the hub in a retracted configuration.
Figure 5:
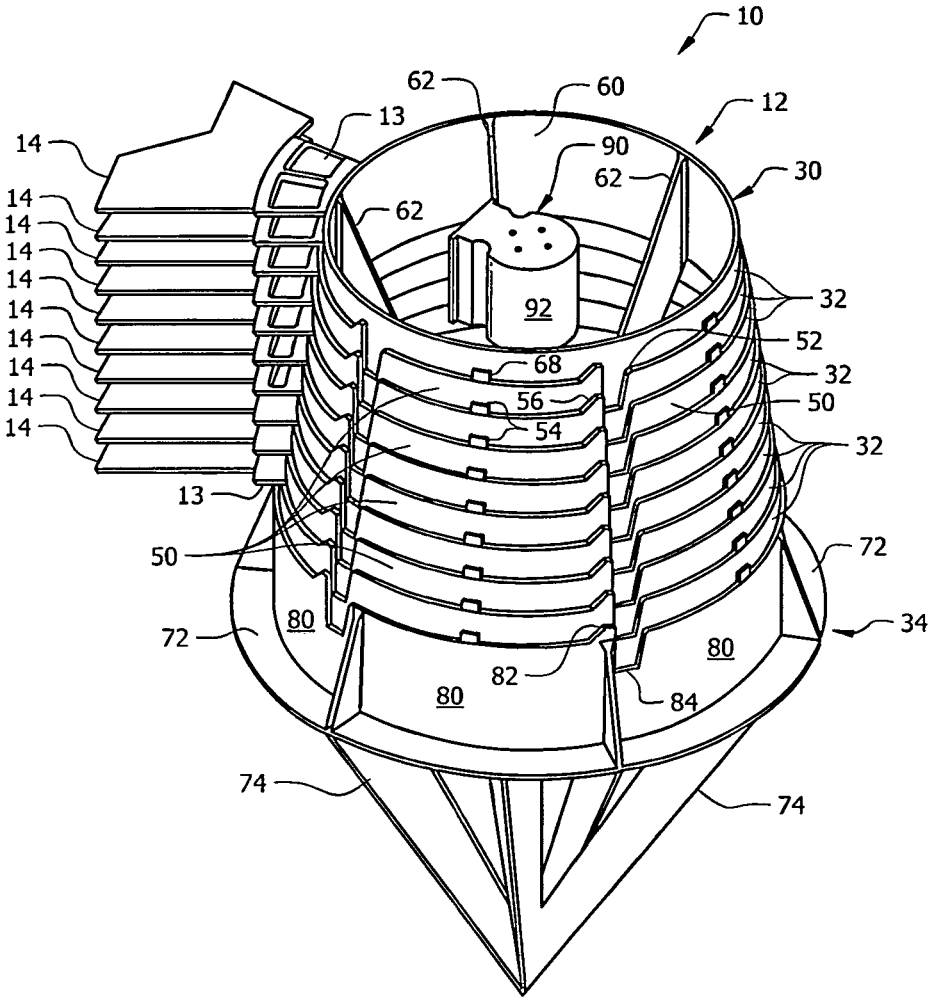
FIG. 5 is a perspective view of reflector system shown in FIGS. 1-4, with the panels in the stowed configuration and the hub in the extended configuration.

The panels 14 can be shaped so that the reflector 11 has a curved three-dimensional shape when deployed, as shown in FIG. 4. For example, the curved three-dimensional shape can be parabolic. The panels 14 of alternative embodiments can be shaped so that the reflector 11 has other types of curvature, or no curvature at all.

The skin 22 of each panel 14 preferably has a surface roughness of approximately 0.010-inch or lower, root mean square (RMS) to facilitate optimal reflection of high-frequency radio frequency (RF) signals.

Figure 7:
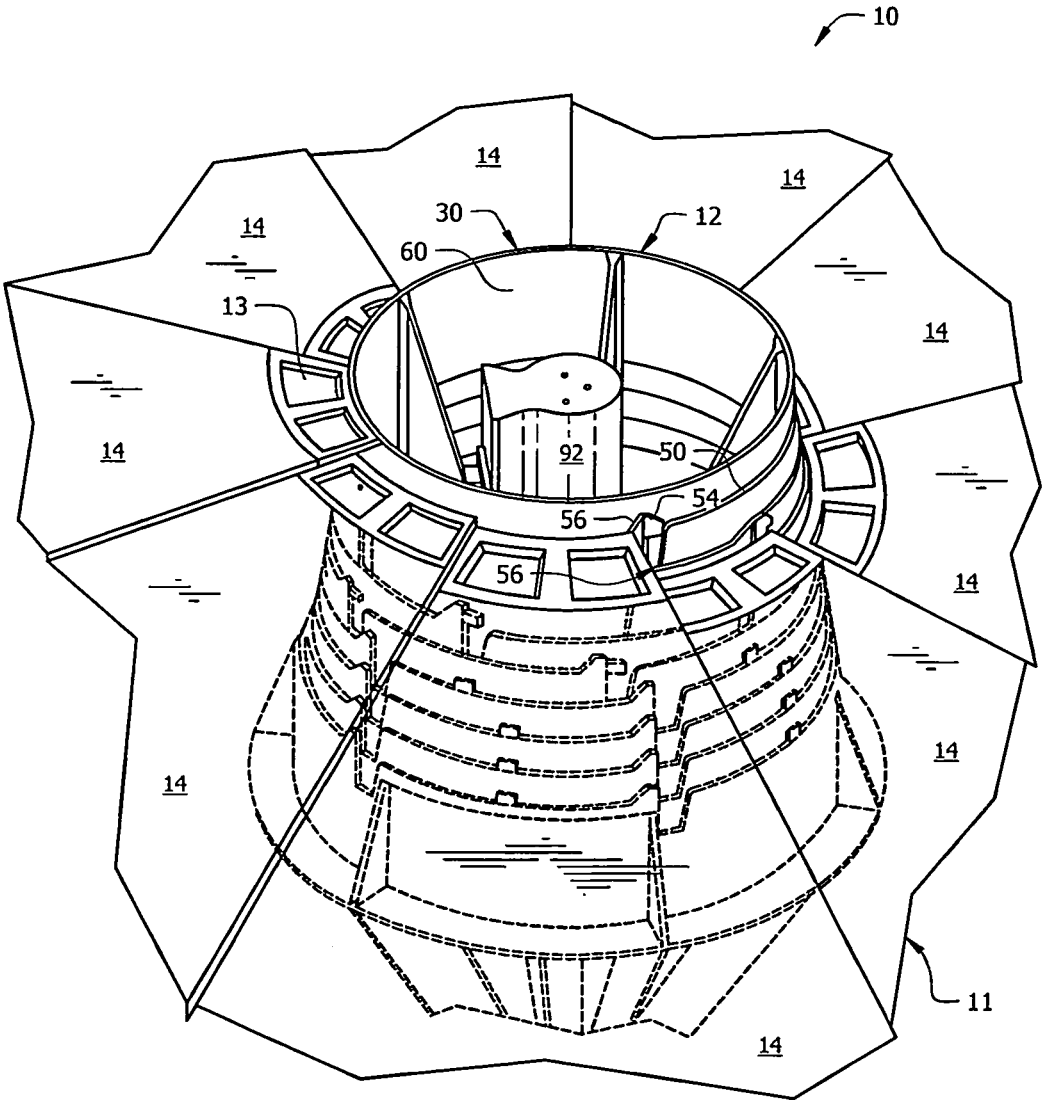
FIG. 7 is a perspective view of the reflector system shown in FIGS. 1-6, with the panels in the semi-deployed configuration and the hub in the extended configuration.
Figure 9:
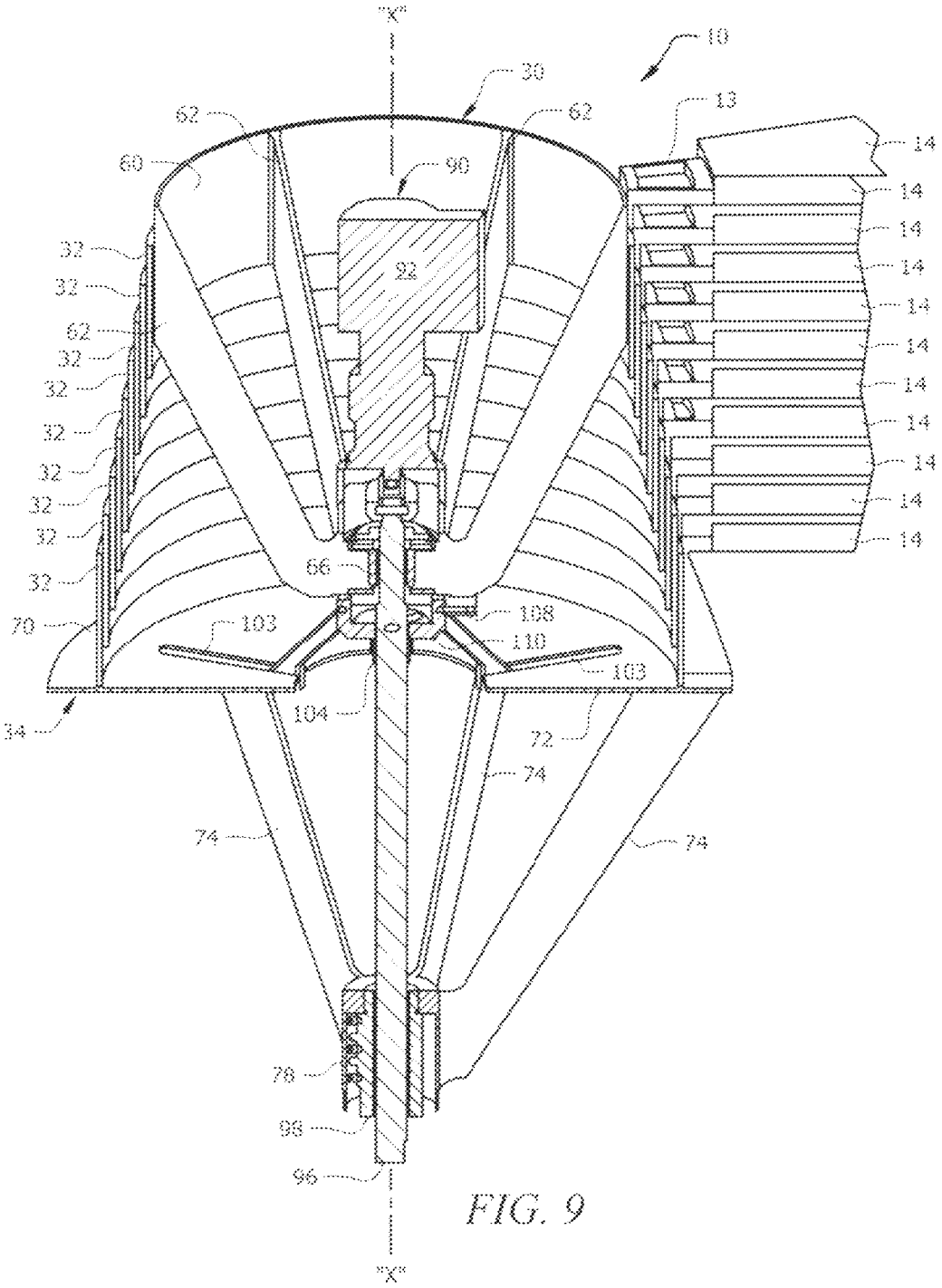
FIG. 9 is a cross-sectional view of the reflector system shown in FIGS. 1-8, taken along the line "B-B" of FIG. 6, with the panels in the stowed configuration and the hub in the extended configuration.

The hub 12 can include a first or upper shell 30, eight shells or rings 32, and a second or lower shell 34, as shown in FIGS. 5, 7, and 9. One of the panels 14 is mounted on the upper shell 30, another panel is mounted on the lower shell 34, and the remaining panels 14 are each mounted on an associated one of the rings 32.

The upper shell 30, rings 32, and lower shell 34 are concentrically positioned about a central axis "X" of the hub 12, and are nested within each other. The X axis is denoted in FIGS. 9 and 10. The upper shell 30, rings 32, and lower shell 34 can translate in relation to each other in the axial ("X") direction, to configure the hub 12 between an extended configuration shown in FIGS. 1-3, 5-7, 9, 11, 19, and 20, and a retracted configuration shown in FIGS. 4, 8, 10, 14, and 18. Moreover, the upper shell 30, rings 32, and lower shell 34 can rotate in relation to each other.

Figure 8:
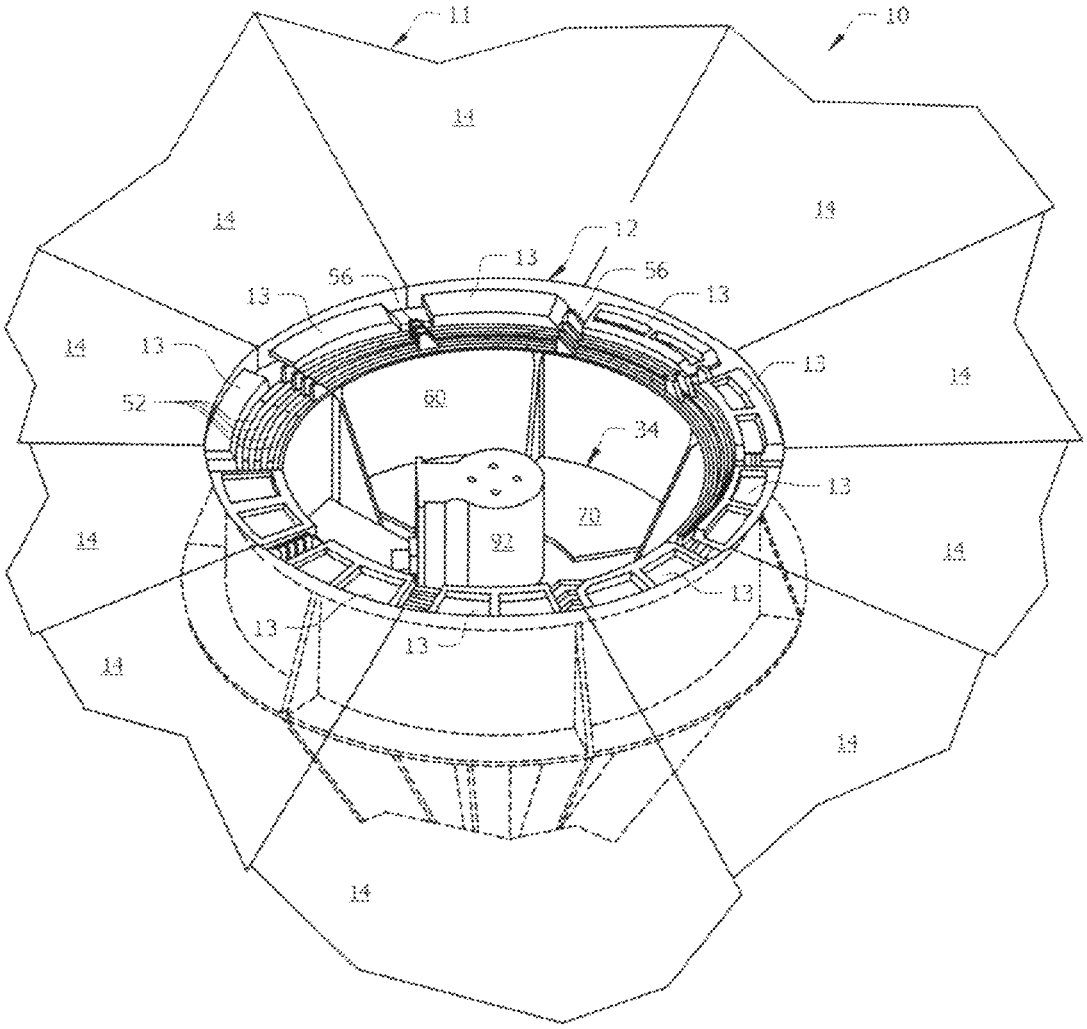
FIG. 8 is a perspective view of the reflector system shown in FIGS. 1-7, with the panels in the deployed configuration and the hub in the retracted configuration.
Figure 10:
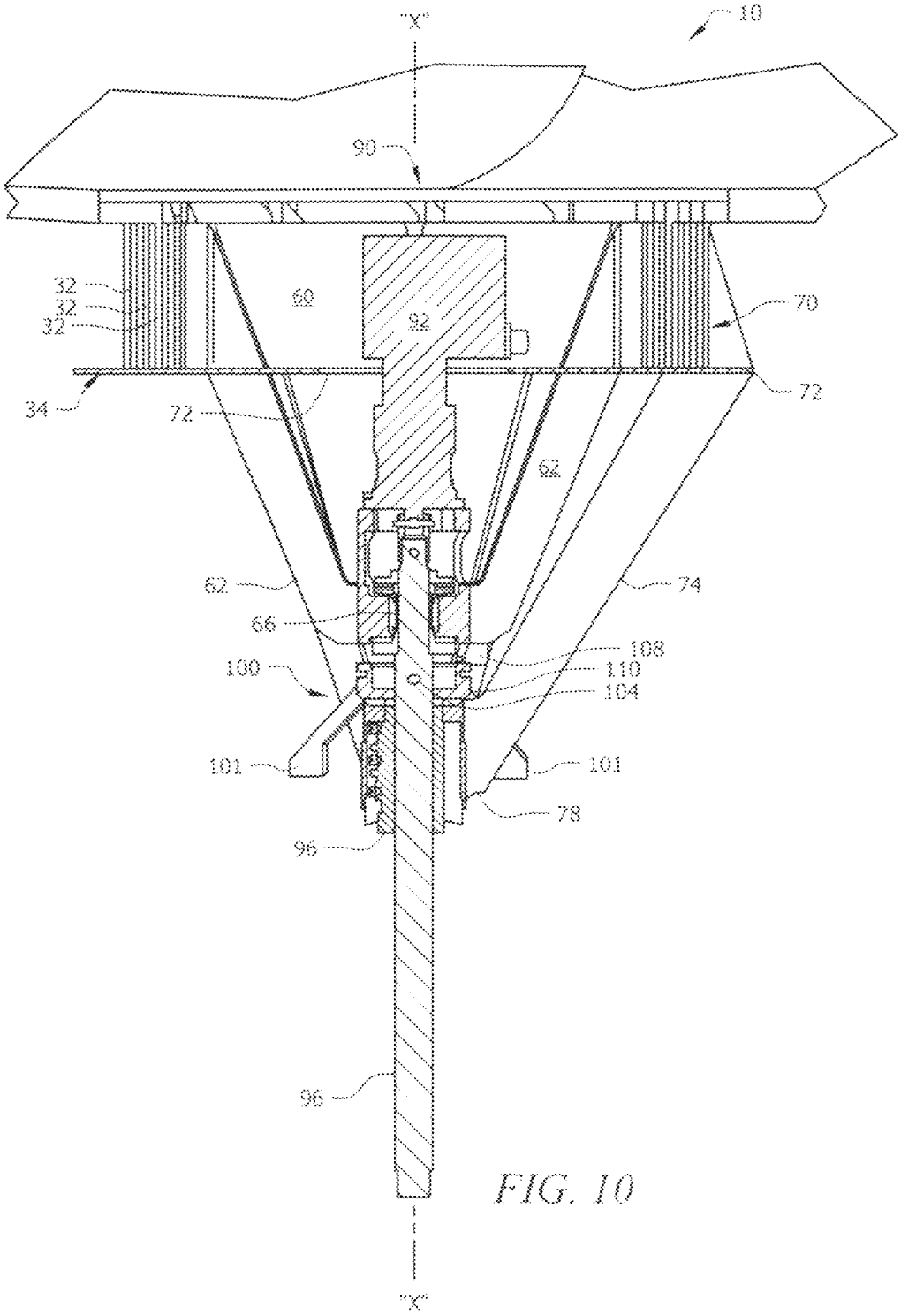
FIG. 10 is a cross-sectional view of the reflector system shown in FIGS. 1-9, taken along the line "B-B" of FIG. 6, with the panels in the deployed configuration and the hub in the retracted configuration.

The upper shell 30, rings 32, and lower shell 34 are fully nested within each other, as depicted in FIGS. 8 and 10, when in the hub 12 is in its retracted configuration. The nested arrangement permits the reflector 11 to assume its fully deployed position in which the panels 14 are disposed in a side by side relationship.

The upper shell 30, rings 32, and lower shell 34 are partially nested within each other, as depicted for example in FIGS. 1, 5, 9, and 11, when the hub 12 is in its extended configuration. This arrangement facilitates the stacking of the panels 14 shown in FIGS. 1, 5, and 13, which gives the reflector system 10 its relatively small footprint when in its stowed configuration.

Each ring 32 includes five substantially identical segments 50. The optimal number of segments 50 in each ring 32 is application-dependent, and can vary with factors such as the overall size of the hub 12. Each segment 50 is separated from its adjacent segments by notches 52 as shown, for example, in FIGS. 5 and 11. The segments 50 each include a raised projection 54 located at the approximate lengthwise mid-point of the segment 50. Each notch 52 has a width, i.e., dimension along the circumferential direction of the ring 32, that is slightly greater than that of the projections 54, so that the projections 54 can fit within the notches 52. Ball bearings or other low-friction devices can be used with, or in lieu of the projections 54 in alternative embodiments.

Figure 11:
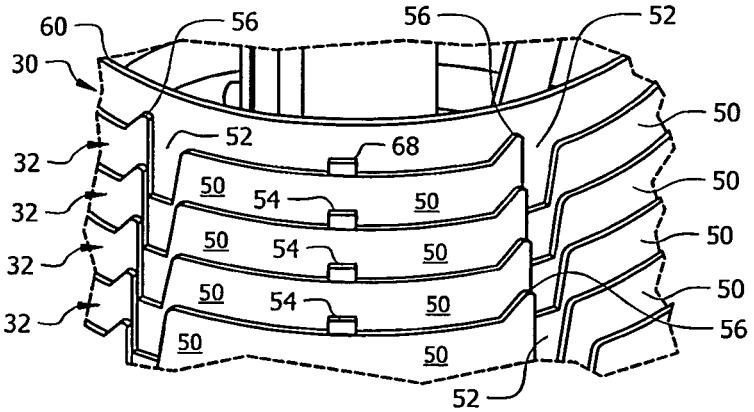
FIG. 11 is a magnified view of the area designated "A" in FIG. 5.

Each segment 50 also includes an end portion 56 as shown, for example, in FIGS. 5 and 11. The end portions 56 each have a vertical dimension, or height (from the perspective of FIG. 5), that is greater than that of the adjacent portion of the segment 50.

The upper shell 30 includes a ring portion 60, and a plurality of struts 62 that adjoin the inner circumference of the ring portion 60, as shown in FIGS. 9 and 10. The struts 62 extend downwardly and inwardly, and converge in a hub 66. A plurality of projections 68, substantially identical to the projections 54 on the segments 50 of the rings 32, are formed on the ring portion 60. Ball bearings or other low-friction devices can be used with, or in lieu of the projections 68 in alternative embodiments.

The lower shell 34 includes a ring portion 70, and a flange portion 72 that adjoins a bottom edge of the ring portion 70, as shown in FIGS. 5, 9, and 10. The lower shell 34 also includes a plurality of struts 74 that adjoin the flange portion 72. The struts 74 extend downwardly and inwardly, and converge in a hub 78. The ring section 70 includes a plurality of substantially identical segments 80, as shown in FIG. 5. Each segment 80 has an end portion 82 that is substantially identical to the end portions 56 on the rings 32. A plurality of notches 84, substantially identical to the notches 52 on the rings 32, are formed between each segment 80.

The reflector system 10 can be mounted via the lower shell 34. For example, FIGS. 13 and 14 depict a space-based application in which the reflector system 10 is mounted at the end of a movable boom arm 200, via mounts that are secured to the lower shell 34.

The hub 12 also includes an actuator 90 as shown, for example, in FIGS. 9 and 10. The actuator 90 includes a rotary drive, such as an electric motor 92, mounted on the hub 66 of the upper shell 30. The motor 92 can be electrically coupled to a power source (not shown) on a selective basis, to facilitate activation and deactivation of the motor 92.

The actuator 90 also includes a ball screw assembly comprising a ball screw 96 and a ball nut 98, as shown in FIGS. 9 and 10. The ball screw 96 is coupled to the motor 92 so that the motor 92, when activated, rotates the ball screw 96. The term "coupled," as used herein, is intended to denote both direct and indirect connections between two or more parts or components. The ball screw 96 extends through a centrally-located opening in the hub 66 of the upper shell 30, and is rotatably coupled to the hub 66 via a bearing. The ball nut 98 is fixed to the hub 78, within a centrally-located opening in the hub 78.

The actuator 90 also includes a synchronizer 100, depicted in FIGS. 9, 10, 12A, and 12B. The synchronizer 100 is concentrically disposed around the ball screw 96. The synchronizer 100 is coupled to the ball screw 96 on a selective basis via a first pin 104, so that the synchronizer 100 rotates with the ball screw 96.

The synchronizer 100 has a plurality of legs 101 that extend downwardly and outwardly, from the perspective of FIGS. 9 and 10. The legs 101 extend through slots 103 formed in the flange portion 72 of the lower shell 34, and engage the flange portion 72. The legs 101 thereby couple the lower shell 34 to the remainder of the synchronizer 100 and the ball screw 96, so that the rotational motion of the ball screw 96 is transferred to the lower shell 34. As discussed below, rotation of the lower shell 34 causes the upper shell 30 and the rings 32 to rotate, which in turn causes the panels 14 to move from their stacked or stowed configuration, to a semi-deployed configuration depicted in FIGS. 3 and 7.

The synchronizer 100 has an upper position, depicted in FIGS. 9 and 12A. The synchronizer 100 has first slot 120 formed in a lower portion thereof, as shown in FIG. 12A. The first pin 104 rests in the first slot 120 when the synchronizer 100 is in its upper position. The pin 104 engages the synchronizer 100 when disposed in the first slot 120, thereby coupling the synchronizer 100 to the ball screw 96 so that the synchronizer 100 and the lower shell 34 rotate with the ball screw 96.

The hub 66 of the upper shell 30 includes two tabs 108, depicted in FIGS. 9, 10, and 12A. Two pins 110 are mounted on respective tabs 108, and extend inwardly, toward the X axis. The pins 110 are referred to hereinafter as "second pins 110," for clarity. Only one of the second pins 110 and its associated tab 108 are depicted in FIG. 12A, for clarity of illustration The second pins 110 selectively engage the synchronizer 100 via a circumferentially-extending second slot 112 formed in a upper portion of the synchronizer 100, as depicted in FIGS. 12A and 12B.

The synchronizer 100 is biased downwardly, from the perspective of FIGS. 9, 10, 12A, and 12B, by a spring (not shown). The synchronizer 100 is held in its upper position, against its spring bias, by the second pins 110.

Figure 3:
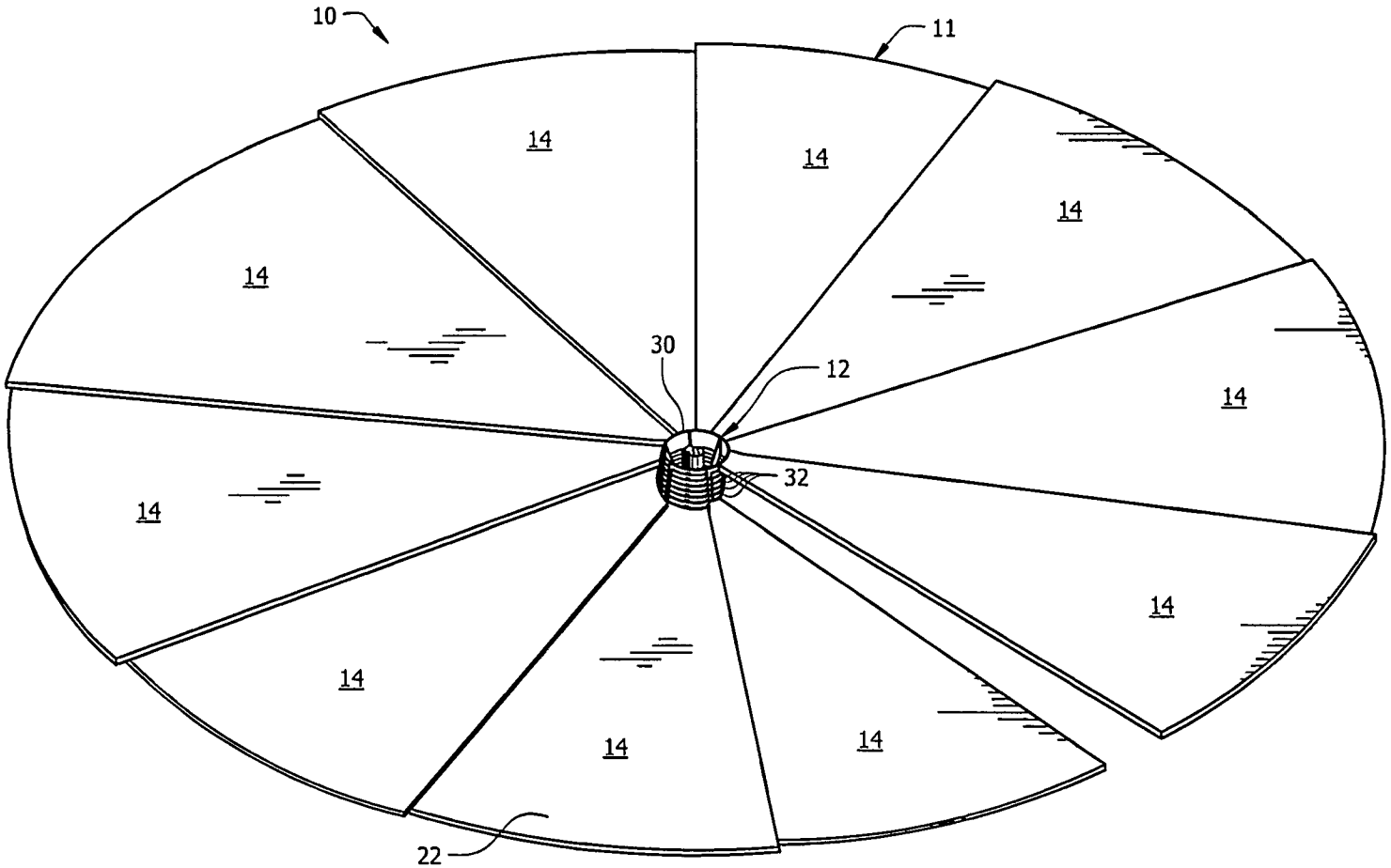
FIG. 3 is a perspective view of the reflector system shown in FIGS. 1 and 2, with the panels in the semi-deployed configuration and the hub in the extended configuration.

As discussed below, the second pins 110 can move out of the second slot 112 and thereby disengage from the synchronizer 100 when the panels 14 reach their semi-deployed configuration shown in FIGS. 3 and 7. The synchronizer 100 moves downwardly in response to its spring bias, to the position depicted in FIG. 10, upon disengagement of the second pins 110. The first pin 104 no longer resides in the first slot 120 after the synchronizer 100 has moved downward, and the synchronizer 100 and ball screw 96 are thereby decoupled with respect to rotation, i.e., rotation of the ball screw 96 will not result in corresponding rotation of the synchronizer 100 and the lower shell 34.

The ball screw 96 will rotate in relation to the ball nut 98 when the synchronizer 100 and the lower shell 34 are decoupled from the ball screw 96. The rotation of the ball screw 96 in relation to the ball nut 98 causes the ball nut 98 and the lower shell 34, to which the ball nut 98 is fixed, to move downwardly or upwardly in relation to the upper shell 30, depending on the direction of rotation of the ball screw 96, as depicted in FIG. 10.

The reflector 11 can be deployed in a two-step process. The panels are initially rotated from their stacked to their semi-deployed configuration, while the hub 12 remains in its extended configuration. The hub 12 is then moved axially, from its extend position to its retracted configuration, to bring the panels 14 into their side by side deployed relationship, thereby configuring the reflector 11 into its final parabolic profile.

Figure 1:
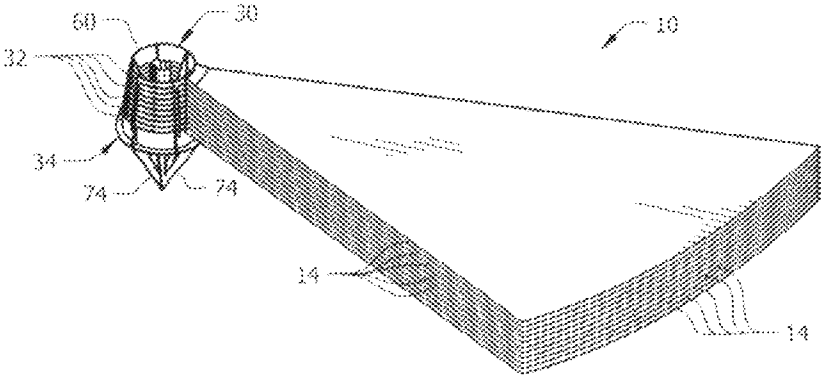
FIG. 1 is a perspective view of a reflector system, with panels thereof in a stowed configuration and a hub thereof in an extended configuration.
Figure 2:
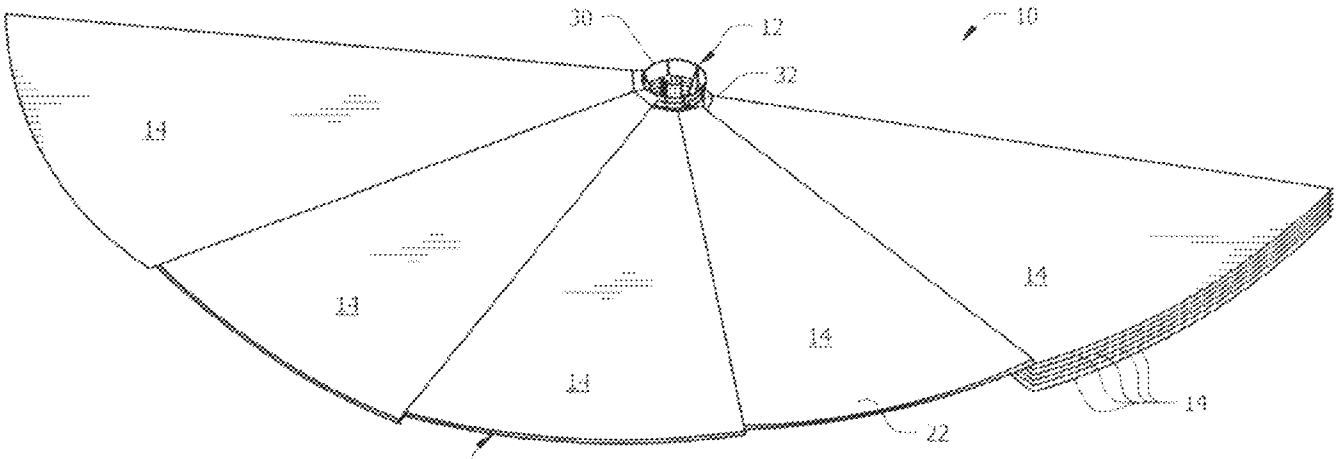
FIG. 2 is a perspective view of the reflector system shown in FIG. 1, with the panels moving between the stowed configuration and a semi-deployed configuration, and the hub in the extended configuration.

Deployment of the reflector 11 is initiated by activating the motor 92, which causes the attached ball screw 96 to rotate in relation to the motor 92. At the start of the deployment process, as shown in FIGS. 1, 5, and 14, the panels 14 are vertically aligned, or stacked, and the hub 12 is in its extended configuration to facilitate the stacking of the panels 14. Moreover, the second pins 110 are disposed within the second slot 112 on the synchronizer 100 as depicted in FIG. 12, so that the synchronizer 100 is held in its upper position and the first pin 104 remains positioned within the first slot 120 in the synchronizer 100. The lower shell 34, therefore, is coupled for rotation with the ball screw 96 via the synchronizer 100.

The motor 92, upon activation, exerts a torque on the ball screw 96. The ball screw 92, in turn, exerts a reactive torque on the motor 92. The lower shell 34 is fixed in relation to the structure adjacent to the reflector system 10, and the ball screw 92 is fixed to the lower shell 34 via the first pin 104. Therefore, the reactive force exerted by the ball screw 96 on the motor 92 causes the upper shell 30, to which the motor 92 is fixed, to rotate in relation to the ball screw 96 and the lower shell 34. The upper shell 30 can also rotate in relation to the rings 32.

Figure 6:
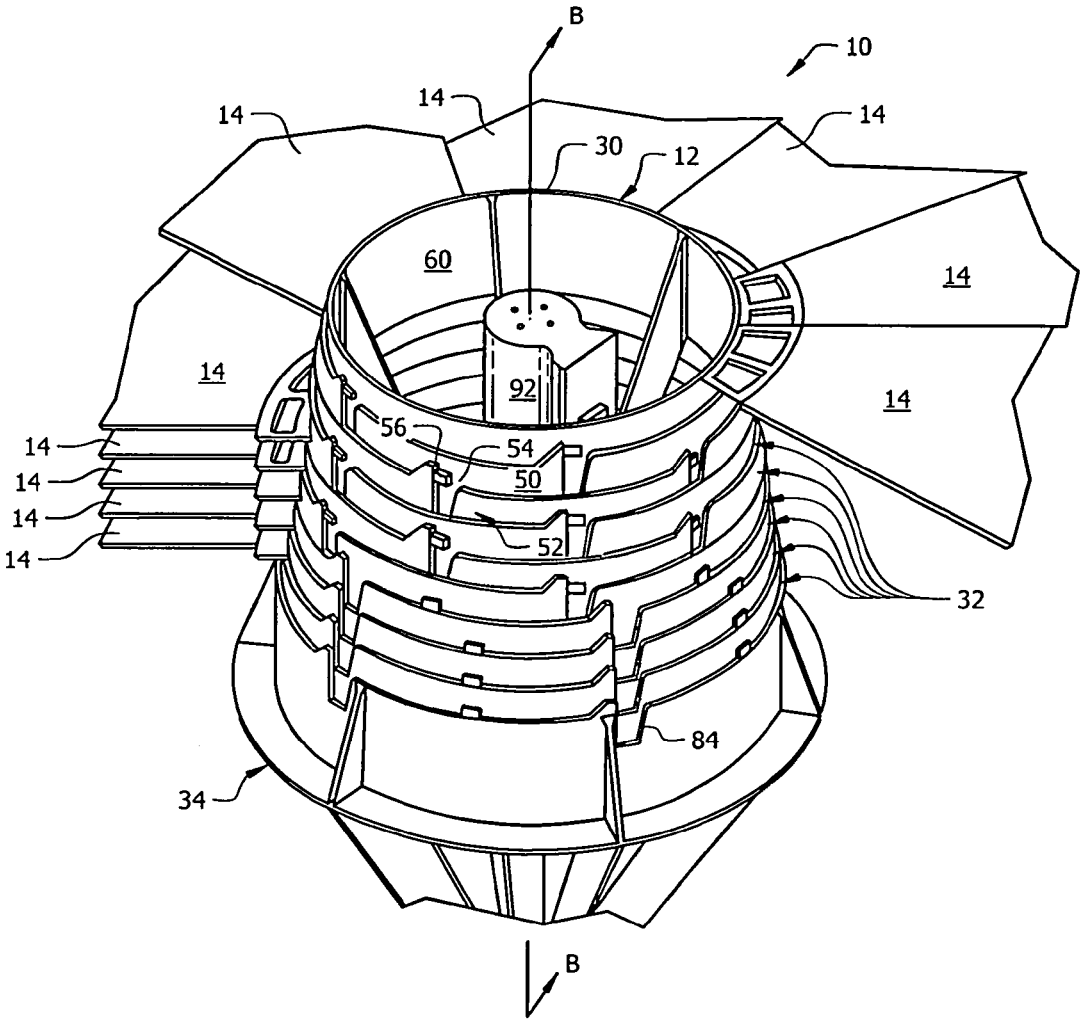
FIG. 6 is a perspective view of the reflector system shown in FIGS. 1-5, with the panels moving between the stowed and semi-deployed configurations and the hub in the extended configuration.

The rotation of the upper shell 30 eventually causes each of the projections 68 on the upper shell 30 to abut an end portion 56 of one of the segments 50 on the adjacent, or uppermost ring 32 as depicted in FIG. 6. The end portions 56, as discussed above, each have a height that is greater than the height of the adjacent portion of the segment 50. This feature facilitates the abutment of the projections 68 and the segments 50 of the adjacent ring 32.

Further rotation of the upper shell 30 after the projections 68 have contacted the end portions 56 of the adjacent ring 32 causes the adjacent ring 32 to rotate along with the upper shell 30, i.e., the adjacent ring 32 is pushed in the direction of rotation of the upper shell 30 by the projections 68.

Continued rotation of the upper shell 30 and the uppermost ring 32 eventually causes the projections 54 on the uppermost ring 32 to contact the end portions 56 on the segments 52 of its adjacent, or second highest ring 32, as shown in FIG. 6. The engagement of the projections 54 and the end portions 56 causes the second highest ring 32 to rotate along with the upper shell 30 and the uppermost ring 32. Because the hub 12 at this point remains in its extended configuration, the axial (X-axis) positions of the upper shell 30 and the rings 32 remain substantially constant as the upper shell 30 and the rings 32 rotate about the X axis.

The above deployment process continues as the upper shell 30 continues to rotate, with each ring 32 causing its adjacent ring 32 to rotate, until the lowermost ring 32 has been rotated so that its projections 54 engage the end portions 82 on the ring portion 70 of the lower shell 34 as shown in FIG. 7. The panels 14 at this point are in their semi-deployed configuration in which all of the panels 14 have assumed their final angular, or clock position about the X axis as depicted in FIGS. 3 and 7. Moreover, each projection 68, 54 on the upper shell 30 and the rings 32 is aligned with a corresponding notch 52, 84 on the rings 32 or the lower shell 34 at this point.

Until this point in the deployment process, the engagement of the first pin 104 and the synchronizer 100 has prevented relative rotation between the lower shell 34 and the ball screw 96. Thus, the ball screw 96 has not rotated in relation to the ball nut 98, the relative axial positions of the lower shell 34 and the ball screw 96 have remained the same, and the hub 12 has remained in its extended position.

As discussed above, the engagement of the synchronizer 100 and the second pins 110 hold the synchronizer 100 in its upper position, causing the first pin 104 to remain in the first slot 120 in the synchronizer 100, which in turn causes the ball screw 96 and the lower shell 34 to remain coupled to the synchronizer 100.

The hub 12 is configured so that the second pins 110 can exit the second slot 112 as the panels 14 reach their semi-deployed configuration, thereby permitting the synchronizer 100 to move to its lower position. When the synchronizer 100 is in its lower position, the first pin 104 is disengaged from the first slot 120, and the synchronizer 100 thereby is decoupled from the first pin 104 and the ball screw 96, which in turn permits the hub 12 to retract as discussed below.

Disengagement of the second pins 110 from the second slot 112 can be effectuated through the use of two slots 116 formed in the synchronizer 100, as shown in FIG. 12A. The slots 116 are referred to hereinafter as "third slots 116," for clarity. The third slots 116 adjoin the second slot 112. The second pins 110 can exit the second slot 112 via the third slots 116 when the second pins 110 each becomes aligned with one of the third slots 116, as shown in FIG. 12A.

The synchronizer 100 can be configured so that the second pins 110, which are mounted on the upper shell 30, each align with a respective one of the third slots 116 as the upper shell 30 reaches the end of its rotational movement, which coincides with the panels 14 reaching their semi-deployed configuration. When the second pins 110 align with the third slots 116, the second pins 110 can exit the synchronizer 100 so that the synchronizer 100 is no longer held in its upper position by the second pins 110, and the synchronizer 100 can move downwardly under its spring bias to its lower position, as denoted by the arrow 119 in FIG. 12B. The synchronizer 100 and the lower shell 34 thereby become decoupled from rotation with the ball screw 96 when the panels 14 reach their semi-deployed configuration.

FIG. 12C depicts an alternative embodiment of the synchronizer 100 in the form of a synchronizer 100*a*. The synchronizer 100*a* has a spiral slot 112*a* formed therein for receiving the second pins 110. The synchronizer 100*a* rotates with the upper shell 30 when the first pin 104 engages the synchronizer 100*a* via a first slot (not shown) in the synchronizer 100*a*. The first slot of the synchronizer 100*a* is substantially identical to the first slot 120 of the synchronizer 100.

Rotation of the synchronizer 100*a* in relation to the second pins 110 causes the second pins 110 to travel gradually toward the open end of the second slot 112*a*. The spiral configuration of the slot 112*a* causes the second pins 110 to cam, or urge the synchronizer 100*a* downward as the synchronizer 100*a* rotates in relation to the second pins 110. The second slot 112*a* is configured so that one of the second pins 110 exits the second slot 112*a* before the shell 30 reaches the end of its rotational movement, and the other one of the second pins 110 exits the slot 112*a* as the shell 30 reaches the end of its rotational movement and the synchronizer 100*a* reaches a lower position as shown in FIG. 12C.

The first pin 104 disengages from the first slot when the synchronizer 100*a* reaches its lower position. The synchronizer 100*a* thereby becomes decoupled from rotation with the ball screw 96 when the upper shell 30 reaches the end of its rotational movement and the panels 14 reach their semi-deployed configuration, and the hub 14 can move to its retracted position as discussed below.

The ball nut 98 is fixed to the lower shell 34. The ball screw 96 thus rotates in relation of the ball nut 98 once the lower shell 34 has been decoupled from the ball screw 96. Because the reflector system 10 is mounted via the lower shell 34, the lower shell 34 and the attached ball nut 98 remain stationary in relation to the rotating ball screw 96. Rotation of the ball screw 96 in relation to the stationary ball nut 98 causes the ball screw 96 to translate downwardly, or "walk down," the ball nut 98 as shown in FIGS. 9 and 10. Because the ball screw 96 is coupled to the motor 92, and the motor 92 is fixed to the upper shell 30, the downward motion of the ball screw 96 imparts a corresponding downward motion to the upper shell 30 in relation to the lower shell 34.

The downward movement of the upper shell 30 causes the ring portion 60 of the upper shell 30 to retract, or nest, within the adjacent, or uppermost ring 32 as depicted in FIGS. 8 and 10. The retraction of the ring portion 60 within its adjacent ring 32 causes the two panels 14 associated with the upper shell 30 and the uppermost ring 32 to assume their side by side, or deployed relationship, and also causes the projections 68 on the upper shell 30 to become disposed within the notches 52 of uppermost ring 32.

The mount 13 of the panel 14 associated with the upper shell 30 contacts the upper edge of the adjacent, or uppermost ring 32 when the ring portion 60 of the upper shell 30 has fully retracted into the uppermost ring 32, as shown in FIGS. 8 and 10. This contact, in conjunction with the continued downward movement of the upper shell 30, cause the mount 13 to urge the uppermost ring 32 downwardly, so that the uppermost ring 32 retracts within the adjacent ring 32, and the projections 54 on the uppermost ring 32 become disposed within the notches 52 on the adjacent ring 32. At this point, the panels 14 associated with the upper shell 30 and the uppermost two rings 32 have assumed their side by side deployed relationship.

As the retraction process continues, each ring 32 retracts or nests within its adjacent ring 32, and the projections 54 of each ring 30 become disposed within the notches 52 the adjacent ring 32 as the mounts 13 associated with the upper shell 30 and the higher rings 32 urge each successive ring 32 downward. Alternatively, the projections 68, 54 on the upper shell 30 and the rings 32 can be configured so that the projections 68, 54, rather than the mounts 13, exert a downward force on the rings 32 during the retraction process.

The lowermost ring 32 eventually retracts within the ring portion 70 of the lower shell 34, and the projections 54 of the lowermost ring 52 become disposed within the notches 84 in the lower shell 34. The hub 12 at this point has been fully retracted, and the motor 92 can be deactivated based on input from a suitable sensor such as a limit switch (not shown). Alternatively, or in addition, the motor 92 can be equipped with a clutch (not shown) that causes the motor 92 to disengage from the ball screw 96 when the hub 12 has been fully retracted. All of the panels 14 at this point are in a side by side relationship, and the reflector 11 is in its fully deployed parabolic configuration as depicted in FIGS. 4, 8, 10, 14, and 18.

It is believed that the above deployment process, when conducted under one-g or zero-acceleration conditions, can be performed without the use, or with minimal use of counterbalance tooling.

If required or otherwise desired for a particular application, the actuator 90 can be configured so that the reflector 11 can be returned to its stowed configuration after being deployed. In particular, the motor 92 can be reversed so that the ball nut 98 walks up the ball screw 96, thereby moving the hub 12 from its retracted to its extended configuration, which in turn moves the panels 14 from their deployed to their semi-deployed configuration. The synchronizer 100 can be equipped with provisions (not shown) that move the synchronizer 100 upward at this point, so that the first pin 104 becomes disposed in the first slot 120 of the synchronizer and thereby re-engages the synchronizer 100, thereby coupling the ball screw 96 and the lower shell 34. Reverse operation of motor 92 after this point will rotate the panels 14 from their semi-deployed to their stacked configuration.

A particular configuration for the actuator 90 has been disclosed herein for exemplary purposes only. Virtually any type of mechanism that can generate the above-described rotational and axial movement of the various components of the reflector system 10 can be used as the actuator 90. For example, in one possible alternative embodiment, a lead screw can be used in lieu of the ball screw assembly. In other alternative embodiments, the actuator 90 can include two motors. One of the motors can be used to effectuate the rotational movement of the panels 14, and the other motor can be used to effectuate the linear or axial movement of the various components of the hub 12. In other alternative embodiments, one or more hydraulic or pneumatic actuators can be used in lieu of the motor 92.

The reflector system 10 can include provisions to secure the ends of adjacent panels 14 to each other when the reflector 11 is in its deployed configuration. For example, each panel 14 can be equipped with plungers or detent pins 130 positioned along one or both of its left and right edges. FIG. 15 depicts the detent pins 130 positioned along the right edge of each panel 14. The detent pins 130 can engage the opposing panel 14 via recesses 132 formed in the opposing panel 14, as the hub 12 is retracted and the adjacent panels 14 are drawn together into their side by side deployed relationship. The engagement of the detent pins 130 and the adjacent panel 14 secures the panels 14 to each other while the reflector 11 is deployed. The detent pins 130 thus act as means for interlocking the panels when the panels 14 are in the deployed configuration.

Spring-loaded latches (not shown) can be used in lieu of the detent pins 130 in alternative embodiments. Each latch can have a spring-load pin that engages an adjacent panel 14 via a penetration formed in the adjacent panel in lieu of the recesses 132.

In an alternative embodiment, a toothed spline 140, shown in FIG. 17, can be mounted on the left edge of each panel 14 (as viewed from the perspective of FIG. 17). The spline 140 can be mounted using pins (not shown) or other means that permit a limited degree of movement of the spline 140 along the edge of the panel 14.

A plurality of pins 142 can be mounted proximate the right edge of each panel 14. The pins 142 and the spline 140 can be positioned so that each pin 142 aligns with an area 144 defined by one of the teeth 146 of the spline 140 on an adjacent panel 14, when the panels 14 are rotated into their semi-deployed configuration. Each pin 142 becomes disposed in the associated area 144 as the hub 12 is retracted and the adjacent panels 14 are drawn together into their side by side relationship.

The spline 140 can subsequently be pulled inwardly toward the central X axis, in the direction denoted by the arrow 146. Additional pins 148 can be mounted on each panel 14 proximate the spline 140, as shown in FIG. 17. The pins 148 engage angled surfaces 150 on the side of the spline 140 opposite the teeth 146. The interaction between the angle surfaces 150 and the pins 148 urges the teeth 146 of the spline 140 against the associated pins 142, thereby securing the adjacent panels 14 to each other via the teeth 146 and the spline 140. The splines 140 can be pulled inwardly via a suitable means such as cabling drawn around a spool (not shown) coupled for rotation with the ball screw 96.

In another alternative embodiment, magnetic elements 150 can be mounted on the edges of each panel 14 as shown in FIG. 16. The magnetic elements 150 can be positioned so that the magnet elements 150 on adjacent panels 14 align when the panels 14 reach their side by side deployed configuration. The resulting magnetic attraction between the magnetic elements 150 can secure the adjacent panels 14 to each other.

In another alternative embodiment, depicted in FIG. 18, the panels 14 can have stepped edges, and cables 160 can be used to exert a downward force on each panel 14 to force the overlapping steps on adjacent panels 14 together, thereby securing the adjacent panels 14 to each other.

The reflector system 10 permits a solid reflector to be stored in a compact volume. Thus, the high performance of a solid reflector can be achieved, while at the same time achieving the relatively low storage volume usually associated with flexible wire-mesh reflectors of lesser performance.

Moreover, as a result of the solid-panel configuration, there is no need to make hundred or thousands of cord adjustments to the reflector before and after deployment, as may be required with a flexible wire-mesh reflector to achieve the requisite surface roughness. Also, the solid-panel configuration of the reflector 11 is believed to a more predictable or determinate deployment than a flexible mesh reflector since there are no cords to manage during launch in space-based applications. Moreover, it is believed that the number of parts, and the overall cost of a stowable, solid-panel reflector such as reflector 11 are less than that of a wire-mesh reflector of comparable size and surface roughness.

For example, it is predicted that a solid-panel reflector having an aperture of approximately five meters, constructed with foldable panels as in the reflector system 10, will have a comparable, or potentially smaller stowed volume than a five-meter diameter radial ribwire mesh reflector.

Moreover, the predicted height of the five-meter solid-panel reflector, i.e., the dimension along the lengthwise direction of the stacked panels 14, is approximately 114.5 inches (2.91 meters). The height of the five-meter mesh reflector, by contrast, is approximately 131.7 inches (3.35 meters). This height difference is attributable to the non-scalloped edges of the solid reflector 11, which result in a smaller overall diameter for a solid reflector having the same effective aperture as a flexible wire-mesh reflector with scalloped edges.

The use of the reflector system 10 can thus facilitate the use of relatively large, e.g., five-meter aperture or greater, solid reflectors in applications, e.g., satellite communications, where the use of reflectors of such size would not otherwise be possible or practicable. For example, FIG. 19 depicts the reflector system 10 mounted on a communications satellite 182, with the reflector 10 and the satellite 182 installed in a fairing 180 of a launch vehicle.

FIG. 20 depicts four of the reflector systems 10 installed in a frusto-conical tip portion of a launch-vehicle fairing 186, with each reflector system 10 being mounted on a movable boom arm 200. Each reflector system 10 can be held in place prior to deployment by restraints (not shown) connected to the fairing 186.

We claim:

1. A reflector system, comprising:

a plurality of reflective panels; and a hub comprising:

a plurality of concentric rings, each concentric ring having an outer diameter which is smaller than an inner diameter formed by an adjacent larger one of the concentric rings, and arranged so that the plurality of concentric rings are at least partially nested, said concentric rings rotatably and vertically movable relative to each other, and each said concentric ring having a respective one of the panels mounted thereon and a first central axis which is aligned with a second central axis of all other said concentric rings; and an actuator mechanically coupled to the reflective panels through the concentric rings and comprising a single motor suspended within said plurality of concentric rings such that a third central axis of said single motor is aligned with said first and second central axes, the actuator responsive to operation of the single motor to move the panels between a stowed configuration wherein the panels are stacked in relation to each other, and a deployed configuration wherein the panels are positioned in a side by side relationship so that the panels form a reflector capable of focusing electromagnetic energy incident thereupon;

wherein each of the plurality of concentric rings include an engagement structure which is arranged to facilitate a transfer of a rotation force applied about said first central axis from said concentric ring to an adjacent larger diameter one of the concentric rings, and the single motor is mechanically coupled to an innermost one of the concentric rings to exert the rotation force upon the innermost one of the concentric rings, the engagement structure configured to progressively transfer the rotation force through each said concentric ring in sequence to the adjacent larger diameter one of the concentric rings whereby each of said concentric rings is caused to sequentially rotate about the central axis of the concentric rings when the single motor is operated, and the rigid panels are caused to fully rotate from the stowed configuration to a semi-deployed configuration in which the panels are angularly distributed about the first central axis; and wherein the actuator is further responsive to operation of the single motor to cause the concentric rings forming the hub to retract in a direction aligned with the first central axis after the rigid panels have rotated to their semi-deployed configuration to transition each of the rigid panels from the semi-deployed configuration to the deployed configuration.

2. The system of claim 1, wherein:

the plurality of concentric rings are partially nested within adjacent ones of the plurality of concentric rings, displaced a distance along the first central axis relative to each adjacent one of the concentric rings, when the plurality of reflective panels are in the stored and semi-deployed configurations; and the plurality of concentric rings are fully nested within adjacent ones of the plurality of concentric rings, exclusive of being displaced from each other along the first central axis, when the plurality of reflective panels are in the deployed configuration.

3. The system of claim 1, wherein:

each of the concentric rings comprises a plurality of segments;

the engagement structure includes a projection and an end portion which are formed on each of the segments;

the end portion having a height in the first direction greater than a height of the remainder of the segment;

a notch is formed between each of the segments; and the projection of each of the segments abuts the end portion on one of the segments of an adjacent one of the concentric rings when the concentric rings are rotated, and the projection becomes disposed within one of the notches on the adjacent segment as the plurality of reflective panels move from the stowed configuration to the semi-deployed configurations.

4. The system of claim 1, wherein the hub further comprises a first shell positioned adjacent to and concentric with one of the plurality of concentric rings at a first end of the hub, and a second shell positioned adjacent to and concentric with another one of the plurality of concentric rings at a second end of the hub opposed from the first end.

5. The system of claim 4, wherein:

the single motor is mounted on the upper shell; and the actuator further comprises a ball screw mechanically coupled to the single motor so that the single motor is operable to rotate the ball screw, and a ball nut mounted on the lower shell and engaging the ball screw.

6. The system of claim 5, wherein:

the actuator further comprises a synchronizer that mechanically couples the ball screw for rotation with the second shell on a selective basis;

the first shell and the plurality of concentric rings are operable to rotate about the first central axis of the hub and thereby move the plurality of reflective panels between the stowed and semi-deployed configurations when the single motor is activated and the ball screw is coupled for rotation with the second shell;

the synchronizer is operable to decouple the ball screw from rotation with the second shell when the plurality of reflective panels reach the semi-deployed configuration; and the ball screw and the first shell are configured to move substantially in the first direction in relation to the second shell to retract the hub and thereby move the plurality of reflective panels between the semi-deployed and deployed configurations when the single motor is activated and the ball screw is decoupled for rotation with the second shell.

7. The system of claim 1, further comprising a mechanical coupler mounted on the plurality of reflective panels for interlocking the plurality of reflective panels when the plurality of reflective panels is in the deployed configuration.

8. The system of claim 1, wherein the plurality of reflective panels are solid or rigid wire-mesh panels.

9. The system of claim 1, wherein the reflective panels have substantially the same circumferential position about the first central axis of the hub when the plurality of reflective panels is in the stowed configuration.

10. A reflector system, comprising:

a hub comprising a plurality of concentric rings, each concentric ring having an outer diameter which is smaller than an inner diameter formed by an adjacent larger one of the concentric rings and arranged so that the plurality of concentric rings are at least partially nested, said concentric rings rotatably and vertically movable relative to each other, and a single motor suspended within said plurality of concentric rings such that a central axis of said single motor is aligned with a central axis of each said concentric ring; and a plurality of rigid panels respectively mounted on the plurality of concentric rings and operable for movement between a stowed configuration wherein the plurality of rigid panels substantially overlap, and a deployed configuration wherein the plurality of rigid panels form a reflector capable of focusing electromagnetic energy incident thereupon;

wherein each of the plurality of concentric rings include an engagement structure which is arranged to facilitate a transfer of a rotation force applied about said central axis from said concentric ring to an adjacent larger diameter one of the concentric rings, and the single motor is mechanically coupled to an innermost one of the concentric rings to exert the rotation force upon the innermost one of the concentric rings, the engagement structure configured to progressively transfer the rotation force through each said concentric ring in sequence to the adjacent larger diameter one of the concentric rings whereby each of said concentric rings is caused to sequentially rotate about the central axis of the concentric rings when the single motor is operated, and the rigid panels are caused to rotate from the stowed configuration to a semi-deployed configuration in which the panels are angularly distributed about the central axis; and wherein the single motor is part of an actuator which is responsive to operation of the single motor to cause the plurality of concentric rings forming the hub to retract in a direction aligned with the central axis after all the rigid panels have fully rotated to their semi-deployed configuration to transition the rigid panels from the semi-deployed configuration to the deployed configuration.

11. The system of claim 10, wherein the plurality of rigid panels are operable to move with a combination of rotational and subsequent linear motion when moving between the stowed and deployed configurations.

12. The system of claim 10, wherein adjacent ones of the plurality of rigid panels are in a side by side relationship when the plurality of rigid panels is in the deployed configuration.

13. The system of claim 11, wherein:

the hub has a central axis extending in a first direction;

the hub is operable to move linearly in the first direction to cause the plurality of concentric rings to fully nest within adjacent ones of the plurality of concentric rings and thereby move the plurality of rigid panels from the semi-deployed configuration to the deployed configuration.

14. The system of claim 13, wherein:

each of the plurality of concentric rings comprises a plurality of segments;

the engagement structure includes a projection and an end portion which are formed on each of the segments, the end portion having a height in the first direction greater than a height of the remainder of the segment;

a notch is formed between each of the segments; and the projection of each of the segments abuts the end portion on one of the segments of an adjacent one of the plurality of concentric rings when the concentric rings are rotated, and the projection is configured to become disposed within one of the notches on the adjacent segment as the plurality of rigid panels move from the stowed configuration to the semi-deployed configuration.

15. The system of claim 13, wherein:

the hub further comprises a first shell positioned adjacent to and concentric with the innermost one of the plurality of concentric rings at a first end of the hub, and a second shell positioned adjacent to and concentric with an outermost one of the plurality of concentric rings at a second end of the hub;

the actuator comprising:

the single motor mounted on the first shell;

a ball screw mechanically coupled to the single motor so that the single motor is operable to rotate the ball screw;

a ball nut mounted on the second shell and configured to engage the ball screw; and a synchronizer that is operable to mechanically couple the ball screw for rotation with the second shell on a selective basis;

the first shell and the plurality of concentric rings are configured to rotate about the central axis of the hub and thereby move the plurality of rigid panels between the stowed and semi-deployed configurations when the single motor is activated and the ball screw is coupled for rotation with the second shell;

the synchronizer is operable to decouple the ball screw from rotation with the second shell when the plurality of rigid panels reach the semi-deployed configuration; and the ball screw and the first shell are operable to move substantially in the first direction in relation to the second shell to retract the hub and thereby move the plurality of rigid panels between the semi-deployed and deployed configurations when the single motor is activated and the ball screw is decoupled for rotation with the second shell.

16. The system of claim 10, further comprising couplers mounted on the plurality of rigid panels for interlocking the plurality of rigid panels when the plurality of rigid panels is in the deployed configuration.

17. An antenna system, comprising:

a feed system; and a reflector system comprising a hub and a plurality of rigid panels mounted on the hub and being configured to move between a stowed configuration wherein the plurality of rigid panels substantially overlap, and a deployed configuration wherein the plurality of rigid panels form a reflector capable of focusing radio-frequency energy at the feed system;

wherein said hub comprises a plurality of rings aligned along a central axis of the rings and having a respective one of the plurality of rigid panels mounted thereon, each ring concentric with respect to all other of said plurality of rings and having an outer diameter which is smaller than an inner diameter formed by an adjacent larger one of the rings, each ring of the plurality of rings at least partially nested within the adjacent larger one of the concentric rings, whereby said rings are rotatably and vertically movable relative to each other, an engagement structure respectively provided on each of the plurality of rings which is arranged to facilitate a transfer of a rotation force applied about the central axis of the rings, from each said ring to an adjacent larger diameter one of the rings; and an actuator which includes a single motor suspended within said plurality of rings such that a central axis of said single motor is aligned with the central axis of the rings;

wherein the actuator is mechanically coupled to an innermost one of the rings to exert the rotation force upon the innermost one of the rings, and the engagement structure is configured to progressively transfer the rotation force applied to each said ring in sequence to the adjacent larger diameter one of the rings whereby each of said rings is caused to sequentially rotate about the central axis of the rings when the single motor is operated, whereby the rigid panels are caused to rotate from the stowed configuration to a semi-deployed configuration in which the panels are angularly distributed about the central axis; and wherein the actuator is responsive to operation of the single motor to cause the plurality of rings forming the hub to retract in a direction along the central axis of the rings after all the rigid panels have fully rotated to their semi-deployed configuration to transition the rigid panels from the semi-deployed configuration to the deployed configuration.

18. The system of claim 17, wherein:

the hub further comprises a first shell positioned adjacent to and concentric within an innermost one of the plurality of rings at a first end of the hub, and a second shell positioned adjacent to and concentric with an outermost one of the plurality of rings at a second end of the hub;

the actuator comprises:

the single motor mounted on the first shell;

a ball screw mechanically coupled to the single motor so that the single motor is operable to rotate the ball screw;

a ball nut mounted on the second shell and engaging the ball screw; and a synchronizer that mechanically couples the ball screw for rotation with the second shell on a selective basis;

the first shell and the plurality of rings are configured to rotate about the central axis of the hub and thereby move the plurality of rigid panels between the stowed and semi-deployed configurations when the single motor is activated and the ball screw is coupled for rotation with the second shell;

the synchronizer is operable to decouple the ball screw from rotation with the second shell when the plurality of rigid panels reach the semi-deployed configuration; and the ball screw and the first shell are operable to move substantially in the first direction in relation to the second shell to retract the hub and thereby move the plurality of rigid panels between the semi-deployed and deployed configurations when the single motor is activated and the ball screw is decoupled for rotation with the second shell.

* * * * *